US008474528B2

(12) United States Patent
Peixoto et al.

(10) Patent No.: US 8,474,528 B2
(45) Date of Patent: Jul. 2, 2013

(54) SLURRY BYPASS SYSTEM FOR IMPROVED GRAVEL PACKING

(75) Inventors: Luis Felipe Peixoto, Balikpapan (ID); Raymond J. Tibbles, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 630 days.

(21) Appl. No.: 12/564,599

(22) Filed: Sep. 22, 2009

(65) Prior Publication Data

US 2011/0067863 A1 Mar. 24, 2011

(51) Int. Cl.
*E21B 43/04* (2006.01)

(52) U.S. Cl.
USPC ..... 166/242.3; 138/112

(58) Field of Classification Search
USPC ..... 166/242.3, 227–236; 138/111, 112, 138/116, 108
See application file for complete search history.

(56) References Cited

U.S. PATENT DOCUMENTS

| | | | | |
|---|---|---|---|---|
| 6,279,660 | B1 * | 8/2001 | Hay | 166/336 |
| 6,311,730 | B2 * | 11/2001 | Penza | 138/98 |
| 6,513,588 | B1 * | 2/2003 | Metcalfe | 166/89.2 |
| 6,749,023 | B2 | 6/2004 | Nguyen et al. | |
| 2002/0189808 | A1 | 12/2002 | Nguyen et al. | |
| 2004/0040703 | A1 * | 3/2004 | Longmore | 166/207 |
| 2008/0142227 | A1 * | 6/2008 | Yeh et al. | 166/369 |
| 2009/0120635 | A1 * | 5/2009 | Neal | 166/250.15 |
| 2009/0173497 | A1 * | 7/2009 | Dusterhoft | 166/276 |
| 2009/0178801 | A1 * | 7/2009 | Nguyen et al. | 166/249 |
| 2009/0223669 | A1 * | 9/2009 | Freyer | 166/305.1 |
| 2010/0236775 | A1 * | 9/2010 | Sevre et al. | 166/188 |
| 2010/0243235 | A1 * | 9/2010 | Caldwell et al. | 166/118 |
| 2011/0036567 | A1 * | 2/2011 | Holderman et al. | 166/228 |

* cited by examiner

*Primary Examiner* — Shane Bomar
*Assistant Examiner* — Kipp Wallace
(74) *Attorney, Agent, or Firm* — David G. Matthews; Brandon Clark; Robb D. Edmonds

(57) ABSTRACT

Apparatus and methods for gravel packing. The method is particularly useful for deploying a sand screen assembly having shunt tubes. The apparatus can include two or more tubulars disposed about at least one expandable member. The tubulars are longitudinally aligned with one another and bundled together in a run-in position, and the bundled tubulars radially expand when the expandable member is activated.

24 Claims, 3 Drawing Sheets

Fig. 1
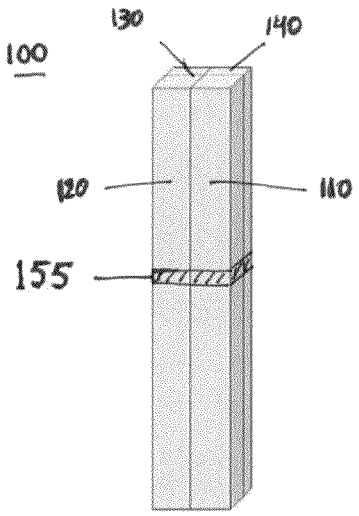
Fig. 2
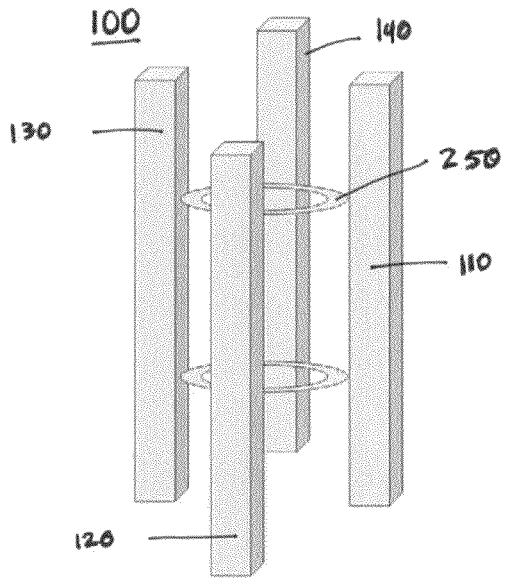
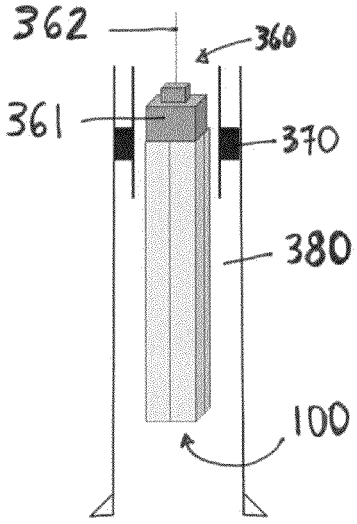
Fig. 3
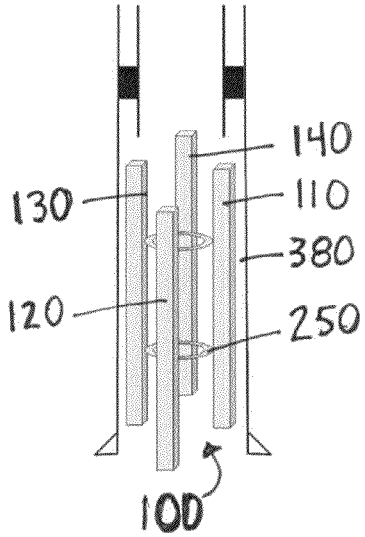
Fig. 4
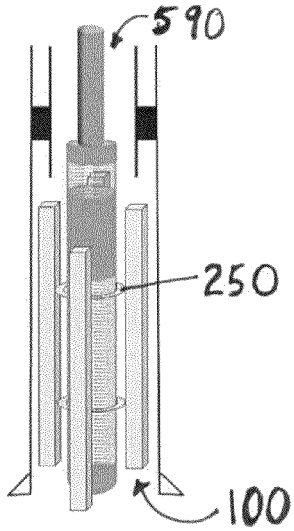
Fig. 5

SLURRY BYPASS SYSTEM FOR IMPROVED GRAVEL PACKING

BACKGROUND

Screen assemblies with permanently attached shunt tubes have been used for gravel packing operations. The shunt tubes allow the gravel a bypass around sand bridges, restrictions, or isolation devices within a wellbore. One major disadvantage is that the shunt tubes can increase the outer diameter of the screen assembly, making it more difficult to run the screen assembly downhole. In addition, a screen assembly with permanently attached shunt tubes can require a specialty screen assembly manufactured to exact specification to stay within a required bore hole diameter. Similarly, shunt tubes can also limit the size of the deployed screen, especially if the wellbore has any restrictions therein.

There is a need, therefore, for alternate flow paths that are temporarily attached to a screen assembly and/or deployed separately from a screen assembly.

SUMMARY

Apparatus and methods for gravel packing are provided. The method is particularly useful for deploying a sand screen assembly having shunt tubes. In at least one specific embodiment, the apparatus includes two or more tubulars disposed about at least one expandable member. The tubulars are longitudinally aligned with one another and bundled together in a run-in position, and the bundled tubulars radially expand when the expandable member is activated.

In at least one specific embodiment of the method, a sand screen assembly and a bundled shunt tube assembly are located within a wellbore. The bundled shunt tube assembly preferably includes two or more tubulars disposed about at least one expandable member, wherein the tubulars are longitudinally aligned with one another and bundled together in a run-in position. The tubulars are separated from one another, and the sand screen assembly is located at least partially within the separated tubulars.

A system for gravel packing is also provided. In at least one specific embodiment, the system includes a conveyance device comprising a deployment head connected to a tubing string and releasably attached to a bundled shunt tube assembly. The bundled shunt tube assembly can include two or more tubulars disposed about at least one expandable member, wherein the tubulars are longitudinally aligned with one another and bundled together in a run-in position, and the bundled tubulars radially expand when the expandable member is activated.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

FIG. 1 depicts an isometric view illustrative of a bundled alternate flow path assembly, according to one or more embodiments described.

FIG. 2 depicts an isometric view illustrative of an expanded alternate flow path assembly, according to one or more embodiments described.

FIG. 3 depicts an isometric view illustrative of deploying a bundled alternate flow path assembly, according to one or more embodiments described.

FIG. 4 depicts an isometric view illustrative of expanding a deployed alternate flow path assembly, according to one or more embodiments described.

FIG. 5 depicts an isometric view illustrative of deploying a sand screen assembly through an expanded deployed alternate flow path assembly, according to one or more embodiments described.

DETAILED DESCRIPTION

Figure 6:
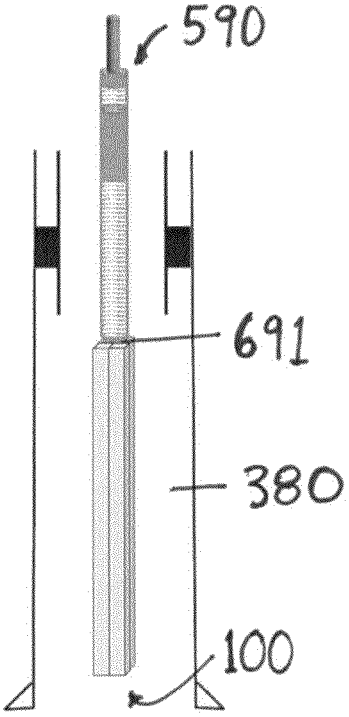
FIG. 6 depicts an isometric view illustrative of deploying a bundled alternate flow path assembly immediately followed by a sand screen assembly, according to one or more embodiments described.

FIG. 1 depicts an isometric view of an illustrative bundled alternate flow path assembly 100 in a bundled or "run-in" position, and FIG. 2 depicts an isometric view of the alternate flow path assembly 100 in an expanded position, according to one or more embodiments. Referring to FIGS. 1 and 2, the assembly 100 can include two or more bundled tubular members (four are shown 110, 120, 130, 140) disposed about at least one expandable member 250 shown in FIG. 2. The tubular members 110, 120, 130, 140 can have a circular cross-section, a rectangular cross section, or any other geometrically shaped cross section. The tubulars 110, 120, 130, 140 can be longitudinally aligned with one another and bundled together in a run-in position, as depicted in FIG. 1. In the run-in or bundled configuration, the tubulars 110, 120, 130, 140 are preferably parallel to one another. But the ends of the tubulars 110, 120, 130, 140 can be equally aligned or off-set from one another.

The tubulars 110, 120, 130, 140 can be bundled together using a ring 155, either on the inside or around the outside of the tubulars 110, 120, 130, 140. The ring 155 can be or include steel, rubber, other elastic materials, or any other rigid material. The tubulars 110, 120, 130, 140 can also be bundled together with a temporary restraining system. The temporary restraining system can include a ring 155 disposed about the tubulars 110, 120, 130, 140. The ring 155 can be secured to the tubulars 110, 120, 130, 140 by a shear pin or other mechanical fastener. Having the tubulars 110, 120, 130, 140 in a bundled configuration, as depicted in FIG. 1, the apparatus can easily traverse through a wellbore and avoid obstructions therein.

After the alternate flow path assembly 100 is located within a wellbore, the bundled tubulars 110, 120, 130, 140 can be radially expanded or expanded to a "second position," as depicted in FIG. 2. The tubulars 110, 120, 130, 140 can be radially expanded by actuation of the expandable member 250. The expandable member 250 can be an annular member, and can be constructed of or at least partially comprise at least one swellable material. The expandable member 250 does not have to be permanent and can degrade after gravel placement or be converted into a packer.

The swellable material can be or include any material that will react with one or more triggers to volumetrically expand or otherwise swell. The trigger(s) can be one or more of the following: fluids, gas, temperature, pressure, Ph, electric charge, and chemicals. Illustrative fluid triggers include water, hydrocarbons, treatment fluids, or any other fluid. Non-limiting examples of materials that can be used to make at least a portion of the swellable material can include polyisoprene, polyisobutylene, polybutadiene, polystyrene, poly (styrene-butadiene), polychloroprene, polysiloxane, poly (ethylene-propylene), chlorosulfonated polyethylene, and/or precursors, mixtures, or derivatives thereof.

In one or more embodiments, the swellable material can be or include one or more materials having different reactivity to one or more downhole triggers. For example, the swellable material can include one or more of polyacrylate, polyurethane and poly (acrylonitrile-butadiene), hydrogenated poly (acrylonitrile-butadiene), polyepichlorohydrin, polysulfide, fluorinated polymers, and/or precursors, mixtures, or derivatives thereof. In one or more embodiments, the swellable material can be or include a fluorinated polymer and/or polyurethane.

In one or more embodiments, the swellable material can be or include one or more polymeric materials that are at least partially crosslinkable. For example, the polymeric material can be formulated to include one or more crosslinking agents or crosslinkers that affect the bulk characteristics of the material without inhibiting swelling kinetics. The swellable material can also include one or more reinforcing agents that impart or improve the mechanical characteristics thereof. Illustrative reinforcing agents include calcium carbonate, clays, silica, talc, titanium dioxide, carbon black, glass microspheres, as well as organic and inorganic nanoscopic fillers.

Still referring to FIG. 2, the expandable member 250 can be located toward a "first" or upper end of the tubular members 110, 120, 130, 140. Similarly, the expandable member 250 can be located toward a "second" or lower end of the tubular members 110, 120, 130, 140. If multiple expandable members 250 are used, the expandable members 250 can be equally spaced or arranged in any frequency along the length of the assembly 100.

In operation, the assembly 100 is located within a wellbore in its run-in position, as depicted in FIG. 3. FIG. 3 depicts an isometric view illustrative of deploying a bundled alternate flow path assembly 100, according to one or more embodiments. As shown in FIG. 3, the bundled assembly 100 has a smaller cross section area and can easily traverse restriction 370 within the wellbore 380. The restriction 370 can be a hanger packer or other completion assembly. Although not shown, an illustrative completion assembly can include sand screens, packers, and flow control devices. The shunt tube assembly 100 can be releasably attached to a conveyance device 360. The apparatus 100 can be lowered with the conveyance device 360. The conveyance device 360 can have a deployment head 361. The deployment head 361 can be connected to one or more tubing strings 362. The tubing strings 362 can be coiled tubing ("CT"), wireline, and/or slickline.

FIG. 4 depicts an isometric view illustrative of expanding a deployed alternate flow path assembly 100, according to one or more embodiments. After the alternate flow path assembly 100 is located at a desired depth in the wellbore 380, the alternate flow path assembly 100 can be expanded. The alternate flow path assembly 100 can be expanded by an expandable member 250, which separates the bundled tubulars 110, 120, 130, 140 from one another. The expandable member 250, shown as an annular, can be actuated electrically, mechanically, or hydraulically. When the tubulars 110, 120, 130, 140 are separated from one another, the tubulars 110, 120, 130, 140 can be referred to as individual tubulars. After the tubulars 110, 120, 130, 140 are expanded the sand screen assembly (not shown) can be at least partial disposed between the tubulars 110, 120, 130, 140.

FIG. 5 depicts an isometric view illustrative of deploying a sand screen assembly 590 through an expanded deployed alternate flow path assembly 100, according to one or more embodiments. As shown in FIG. 5, the sand screen assembly 590 is at least partially disposed within the expanded shunt tube assembly 100. A sand screen assembly 590 can include or be a wire wrapped screen, a mechanical type screen, or combinations thereof. An illustrative sand screen assembly 590 is described in more detail in U.S. Pat. No. 6,725,929. The sand screen assembly 590 can be lowered after expanding the tubulars 110, 120, 130, 140. The lowered screen assembly 590 can be disposed through at least one expandable member 250. The expandable member 250, shown as an annular, can be deployed with tubulars 110, 120, 130, 140 and can be composed of metal, plastic, or some other material. The expandable member 250 does not have to be permanent and can degrade after gravel placement.

Figure 7:
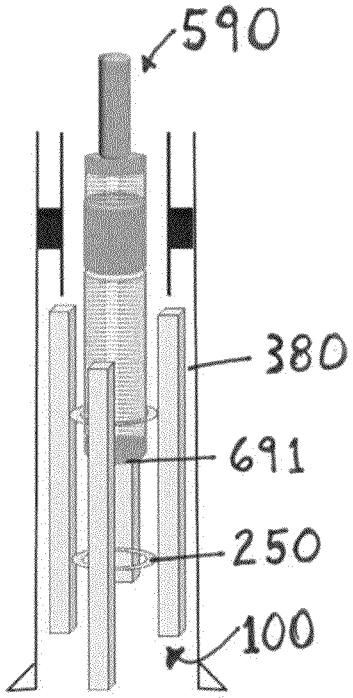
FIG. 7 depicts an isometric view illustrative of a sand screen assembly expanding a bundled alternate flow path assembly, according to one or more embodiments described.
Figure 8:
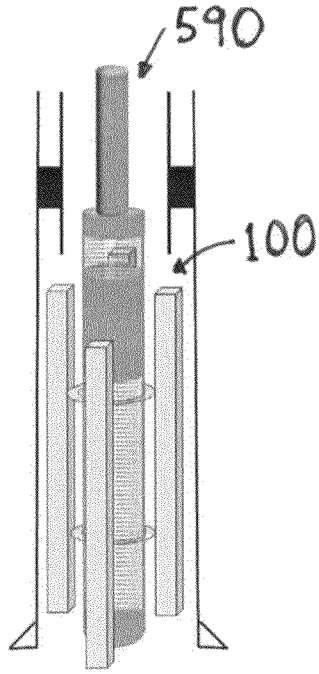
FIG. 8 depicts an isometric view illustrative of an expanded deployed alternate flow path assembly having a sand screen assembly at least partially disposed therethrough, according to one or more embodiments described.

FIGS. 6, 7, and 8 depict an alternative method for deploying alternate flow path assembly 100, according to one or more embodiments described. In operation, the alternate flow path assembly 100 is located within a wellbore 380 in a run-in position. When the alternate flow path assembly 100 is in the run-position, the tubulars 110, 120, 130, 140 can be bundled together, as depicted in FIG. 6. The sand screen assembly 590, having a lower end 691, can be deployed simultaneously or immediately after the alternate flow path assembly 100.

FIG. 7 depicts an isometric view illustrative of the sand screen assembly 590 expanding a bundled alternate flow path assembly 100, according to one or more embodiments. A conveyance device can convey the sand screen assembly 590 and bundled tubulars 110, 120, 130, 140 to a desired placement in the wellbore 380, and the sand screen assembly 590 can be adapted to separate or expand the tubulars 110, 120, 130, 140. The sand screen assembly 590 can be lowered such that the lower end 691 thereof forces the alternate flow path assembly 100 to separate, radially expanding the tubulars 110, 120, 130, 140. In one embodiment, a wedging member disposed at the lower end 691 of the sand screen assembly 590 can manually force the tubulars 110, 120, 130, 140 outward in a radial direction. The wedging member can be connected to the running head or can substitute for the running head. The wedging member can be substantially cone shaped, semi-spherical, pyramid shaped, or triangular. Once separated, the tubulars 110, 120, 130, 140 can be equally displaced from one another and from a common central axis. Alternatively, the tubulars can be displaced to different distances from a common central axis and/or from one another. As displacement occurs, the sand screen assembly 590 can be at least partially disposed between the tubulars 110, 120, 130, 140.

FIG. 8 depicts an isometric view illustrative of an expanded deployed alternate flow path assembly 100 having a sand screen assembly 590 at least partially disposed therethrough, according to one or more embodiments. The sand screen assembly 590 can be located completely or partially between the tubulars 110, 120, 130, 140. In one embodiment, the sand screen assembly 590 can be disposed between at least one expandable member 250, which is shown as an annular component.

Figure 9:
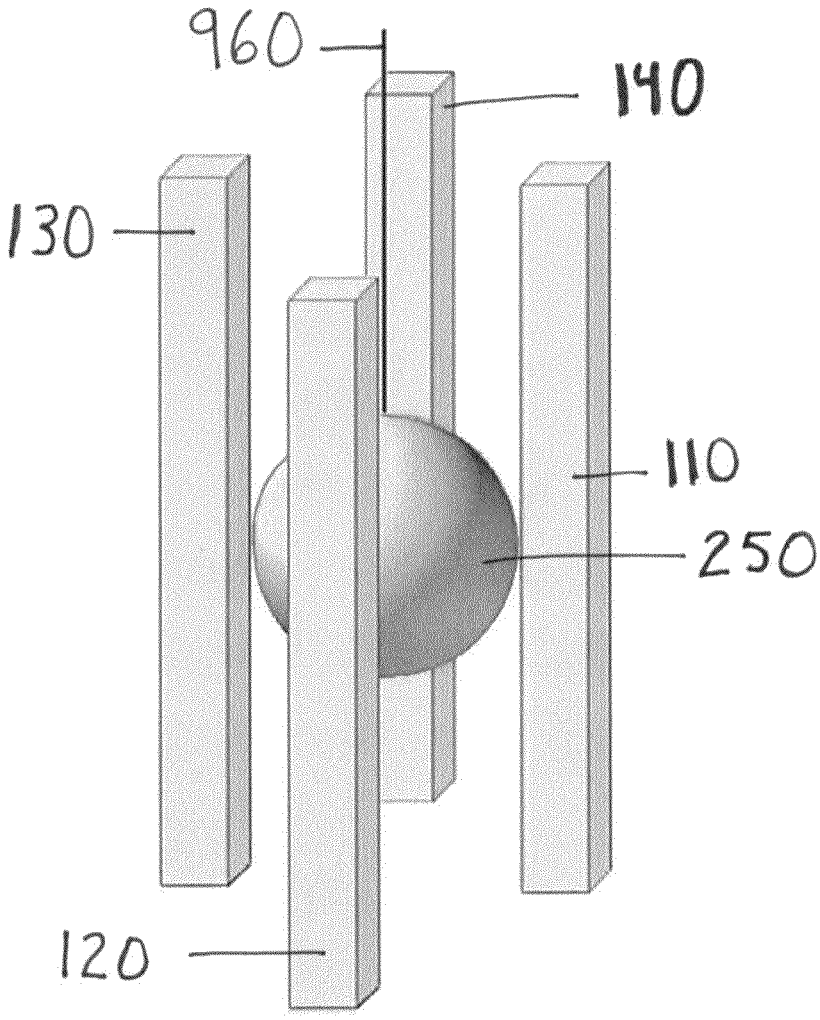
FIG. 9 depicts an isometric view illustrative of an expanded alternate flow path assembly expanded with an inflatable bladder, according to one or more embodiments described.

FIG. 9 depicts an isometric view illustrative of an expanded alternate flow path assembly expanded with the expandable member 250, according to one or more embodiments. The expandable member 250, shown as an inflatable bladder, can be activated or actuated by pumping fluid down a tubing string 960. After separating the tubulars 110, 120, 130, 140, the expandable member 250 can deflate. Once the tubulars 110, 120, 130, 140 are expanded, the tubulars 110, 120, 130, 140 can be self-standing or can lean against a deployed sand screen assembly. Alternatively or in conjunction with the above, the assembly 100 can separate into individual tubulars 110, 120, 130, 140 by activating the expandable member 250 using at least one of mechanical force, hydraulic force, electromagnetic force, or explosive charges. The expandable member 250 can also be activated by an electrically activated tool run on a wireline.

As used herein, the terms "up" and "down;" "upper" and "lower;" "upwardly" and "downwardly;" "upstream" and "downstream;" "top" and "bottom;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Certain embodiments and features have been described using a set of numerical upper limits and a set of numerical lower limits It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An apparatus for gravel packing, comprising:

an expandable member;

two or more tubulars disposed about the expandable member, wherein the tubulars are longitudinally aligned with one another, wherein the tubulars move radially outward when the expandable member is activated, and wherein the expandable member comprises an inflatable bladder; and a restraining device disposed radially outward from the tubulars, wherein the restraining device breaks when the expandable member moves the tubulars radially outward.

2. The apparatus of claim 1, wherein the expandable member is an annular member.

3. The apparatus of claim 1, wherein the restraining device is an elastic material adapted to bundle the tubulars together.

4. The apparatus of claim 1, wherein the restraining device comprises at least one ring disposed about the tubulars, and wherein a shear pin connects the ring to at least one of the tubulars.

5. The apparatus of claim 1, wherein the expandable member is electrically activated.

6. The apparatus of claim 1, wherein the expandable member is activated by one of more of the group consisting of mechanical force, hydraulic force, electromagnetic force, and explosive charges.

7. The apparatus of claim 1, further comprising a conveyance device comprising a deployment head connected to a tubing string, wherein the deployment head is releasably attached to at least one of the tubulars.

8. The apparatus of claim 7, further comprising a sand screen assembly, wherein the expandable member is adapted to separate the two or more tubulars into individual tubulars at least partially disposed about the sand screen assembly.

9. The apparatus of claim 7, wherein the conveyance device further comprises a sand screen assembly adapted to separate the two or more tubulars into individual tubulars at least partially disposed about the sand screen assembly.

10. The apparatus of claim 1, further comprising a sand screen assembly disposed radially inward from the tubulars.

11. The apparatus of claim 1, wherein the restraining device comprises a ring disposed around the tubulars to hold the tubulars in a retracted position.

12. An apparatus for gravel packing, comprising:

an expandable member;

two or more tubulars disposed about the expandable member, wherein the tubulars are longitudinally aligned with one another, wherein the tubulars move radially outward when the expandable member is activated, and wherein the expandable member comprises a swellable material;

a restraining device disposed radially outward from the tubulars, wherein the restraining device breaks when the expandable member moves the tubulars radially outward; and a sand screen assembly at least partially surrounded by the expandable member.

13. The apparatus of claim 12, wherein the sand screen assembly is disposed radially inward from the tubulars.

14. The apparatus of claim 12, wherein the expandable member is an annular member.

15. The method of claim 12, wherein the restraining device is an elastic material adapted to bundle the tubulars together.

16. The apparatus of claim 12, wherein the restraining device comprises at least one ring disposed about the tubulars, and wherein a shear pin connects the ring to at least one of the tubulars.

17. The apparatus of claim 12, wherein the restraining device comprises a ring disposed around the tubulars to hold the tubulars in a retracted position.

18. A method for deploying a sand screen assembly having shunt tubes, comprising:

locating a bundled shunt tube assembly within a wellbore, wherein the bundled shunt tube assembly comprises:

an expandable member;

two or more tubulars disposed about the expandable member, wherein the tubulars are longitudinally aligned with one another, and wherein the expandable member comprises an inflatable bladder; and a restraining device disposed radially outward from the tubulars;

moving the tubulars radially outward with the expandable member, wherein the restraining device breaks when the expandable member moves the tubulars radially outward; and locating a sand screen assembly at least partially within the tubulars.

19. The method of claim 18, wherein moving the tubulars comprises wedging an end of the sand screen assembly between the tubulars.

20. The method of claim 18, wherein moving the tubulars comprises activating the expandable member using at least one of a mechanical force, hydraulic force, electromechanical force, and an explosive charge.

21. The method of claim 18, wherein moving the tubulars comprises activating the expandable member electrically.

22. The apparatus of claim 18, wherein moving the tubulars comprises one of more of the group consisting of application of mechanical force, application of hydraulic force, application of electromagnetic force, and application of explosive forces.

23. An apparatus for gravel packing, comprising:

an expandable member;

two or more tubulars disposed about the expandable member, wherein the tubulars are longitudinally aligned with one another, wherein the tubulars move radially outward when the expandable member is activated, and wherein the expandable member comprises an inflatable bladder; and a restraining device disposed radially outward from the tubulars, wherein the restraining device applies a force on the tubulars in a radially inward direction, and wherein the force applied by the restraining device is less than a force applied on the tubulars in a radially outward direction by the expandable member when the expandable member is activated.

24. An apparatus for gravel packing, comprising:

an expandable member;

two or more tubulars disposed about the expandable member, wherein the tubulars are longitudinally aligned with one another, wherein the tubulars move radially outward when the expandable member is activated, and wherein the expandable member comprises a swellable material;

a restraining device disposed radially outward from the tubulars, wherein the restraining device applies a force on the tubulars in a radially inward direction, and wherein the force applied by the restraining device is less than a force applied on the tubulars in a radially outward direction by the expandable member when the expandable member is activated;and a sand screen assembly at least partially surrounded by the expandable member.

* * * * *